US006744454B2

(12) United States Patent
Mindler et al.

(10) Patent No.: US 6,744,454 B2
(45) Date of Patent: Jun. 1, 2004

(54) METHOD AND APPARATUS FOR REDUCING UNEVEN USE OF HEATING ELEMENTS ON THERMAL PRINT HEAD

(75) Inventors: Robert F. Mindler, Churchville, NY (US); Charles S. Christ, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/274,352

(22) Filed: Oct. 18, 2002

(65) Prior Publication Data

US 2004/0075731 A1 Apr. 22, 2004

(51) Int. Cl.[7] ..... B41J 2/325; B41J 2/335

(52) U.S. Cl. ..... 347/172; 347/206

(58) Field of Search ..... 347/172, 176, 347/180, 181, 182, 183, 188, 190, 193, 195, 206; 400/120.01, 120.02, 120.04, 120.05, 120.06, 120.07, 120.09, 615.2

(56) References Cited

U.S. PATENT DOCUMENTS

| | | | | |
|---|---|---|---|---|
| 4,745,413 A | | 5/1988 | Brownstein et al. | 347/182 |
| 4,933,686 A | * | 6/1990 | Izumi et al. | 347/171 |
| 5,451,985 A | * | 9/1995 | Cho | 347/183 |
| 5,826,994 A | * | 10/1998 | Palmer | 400/615.2 |

* cited by examiner

*Primary Examiner*—K. Feggins
(74) *Attorney, Agent, or Firm*—Roger A. Fields

(57) ABSTRACT

A method of reducing uneven use of a series of heating elements a color image print smaller than the size of the receiver medium and leave a non-image non-color margin area along at least one side of the color image print; and using other ones of the heating elements to effect yellow, magenta and cyan dye transfers superimposed on a non-image non-color margin area left along at least one side of the color image print to make the margin area a shade of substantially gray or black, whereby, since those heating elements which are not to be selectively used to effect the dye transfers to create the color image print are instead used to effect the dye transfers to make a non-image non-color margin area left along at least one side of the color image print a shade of substantially gray or black, uneven use of the heating elements on the print head is reduced.

12 Claims, 3 Drawing Sheets

METHOD AND APPARATUS FOR REDUCING UNEVEN USE OF HEATING ELEMENTS ON THERMAL PRINT HEAD

CROSS REFERENCE TO RELATED APPLICATION

Reference is made to commonly assigned, co-pending application Ser. No. 10/268,814 entitled METHOD AND APPARATUS FOR REDUCING UNEVEN USE OF HEATING ELEMENTS ON THERMAL PRINT HEAD and filed Oct. 10, 2002 in the names of Robert F. Mindler and Charles S. Christ.

FIELD OF THE INVENTION

The invention relates generally to image printers, and in particular to thermal printers in which the selective use of individual heating or resistive elements on a thermal print head effects a color dye transfer from a dye donor medium to a dye receiver medium to create a color image print on the dye receiver medium. More specifically, the invention provides a method and corresponding apparatus for reducing uneven use of the heating elements on the thermal print head.

BACKGROUND OF THE INVENTION

A typical dye donor web that is used in a thermal printer includes a repeating series of three different primary color sections or patches such as a yellow color section, a magenta color section and a cyan color section. Also, there may be a transparent laminating section after the cyan color section.

To make a color image print using a thermal printer, respective color dyes in a single series of yellow, magenta and cyan color sections on a dye donor web are successively heat-transferred (e.g. by diffusion), one on top of the other, onto a dye receiver sheet. Then, optionally, the transparent laminating section is deposited on the color image print. The dye transfer from each color section to the dye receiver sheet is done one line of pixels at a time across the color section via a bead of selectively used heating or resistor elements on a thermal print head. The bead of heating elements makes line contact across the entire width of the dye donor web, but only those heating: elements that are actually used for a particular line are heated sufficiently to effect a color dye transfer to the receiver sheet. The temperature to which a heating element is heated is proportional to the density (darkness) level of the corresponding pixel formed on the receiver sheet. The higher the temperature of the heating element, the greater the density level of the corresponding pixel. Various modes for raising the temperature of the heating element are described in prior art U.S. Pat. No. 4,745,413 issued May 17, 1988.

One example of a color print-making process using a thermal printer is as follows.

1. A dye donor web and a dye receiver sheet are advanced forward in unison, with a yellow color section of the donor web moving in contact with the receiver sheet longitudinally over a stationary bead of heating elements in order to effect a line-by-line yellow dye transfer from the yellow color section to the receiver sheet. A web take-up spool draws the dye donor web forward over the bead of heating elements, and a pair of pinch and drive rollers draw the dye receiver sheet forward over the bead of heating elements. A platen roller holds the dye receiver sheet in a dye receiving relation with the dye donor web at the bead of heating elements.

2. Once the yellow dye transfer is completed, the platen roller is retracted from adjacent the print head to allow the pair of pinch and drive rollers to return the dye receiver sheet rearward in preparation for a second pass over the bead of heating elements.

3. Then, the platen roller is returned to adjacent the print head, and the dye donor web and the dye receiver sheet are advanced forward in unison, with a magenta color section of the donor web moving in contact with the receiver sheet longitudinally over the bead of heating elements in order to effect a line-by-line magenta dye transfer from the magenta color section to the receiver sheet. The magenta dye transfer to the dye receiver sheet is in exactly the same area on the receiver sheet as was subjected to the yellow dye transfer.

4. Once the magenta dye transfer is completed, the platen roller is retracted from adjacent the print head to allow the pair of pinch and drive rollers to return the dye receiver sheet rearward in preparation for a third pass over the bead of heating elements.

5. Then, the platen roller is returned to adjacent the print head, and the dye donor web and the dye receiver sheet are advanced forward in unison, with a cyan color section of the donor web moving in contact with the receiver sheet longitudinally over the bead of heating elements in order to effect a line-by-line cyan dye transfer from the magenta color section to the receiver sheet. The cyan dye transfer to the dye receiver sheet is in exactly the same area on the receiver sheet as was subjected to the yellow and magenta dye transfers.

6. Once the cyan dye transfer is completed, the platen roller is retracted from adjacent the print head to allow the dye receiver sheet to be returned rearward in preparation for exiting the printer.

7. Then, the pair of pinch and drive rollers advance the dye receiver sheet forward to an exit tray.

When printing a 5×7 inch color image on a 6×8 inch dye receiver sheet, for example, a number of the heating elements closest to the opposite ends of the bead of heating elements are not selectively used, i.e. the heating elements closest to the opposite ends of the line are not selectively heated during the yellow, magenta and cyan dye transfers to the receiver sheet. This leaves a pair of 0.5 inch non-image non-color (white) margin areas along opposite sides of the 5×7 inch color image print on the 6×8 inch receiver sheet. Alternatively, when printing a 6×8 inch color image (instead of a 5×7 inch image) on the 6×8 inch receiver sheet, the heating elements closest to the opposite ends of the bead of heating elements are selectively used, i.e. they are selectively heated during the yellow, magenta and cyan dye transfers to the receiver sheet. As a result, a color image print without any non-image margin areas, i.e. a borderless print, is formed. If the heating elements closest to the opposite ends of the bead of heating elements are used less often than the remainder of the heating elements along the bead, there can result an uneven deterioration between the two which causes the resistance values of the two to become materially different over time. Then, when printing the 6×8 inch color image, the material difference in the resistance values between a less-often-used heating element and an adjacent more-often-used heating element causes a corresponding difference in the density (darkness) levels of the dye transfer effected by the less-often-used heating element and the adjacent more-often-used heating element. As a result, an undesirable printing artifact appears as a white or gray line along the printed 6×8 inch color image. This can make the color image print unacceptable.

The Cross-Referenced Application

The cross-referenced application discloses a method of reducing uneven use of a total number of printing elements on a print head in a printer, when selectively using the printing elements to make different size color image prints on respective similar size receiver mediums. The method comprises:

selectively using the total number of printing elements to make color image prints substantially the same size as the receiver mediums; and selectively using a particular number of printing elements less than the total number of printing elements to make similar size color image prints smaller than the receiver mediums, but alternating which ones of the total number of printing elements can be selectively used to make each print so that the placement of each print on a receiver medium is alternated, whereby, since those printing elements that can be selectively used to make each print smaller than a receiver medium are alternated, uneven use of the printing elements is reduced.

SUMMARY OF THE INVENTION

According to one aspect of the invention, a method of reducing uneven use of a series of heating elements on a print head in a thermal printer, when certain ones of the heating elements can be selectively used to effect yellow, magenta and cyan dye transfers superimposed on a dye receiver medium to create a color image print smaller than the size of the receiver medium so that a non-image non-color margin area is left along at least one side of the color image print, and when other ones of the heating elements are not used they leave the non-image non-color margin area unchanged, comprises:

selectively using certain ones of the heating elements to effect yellow, magenta and cyan dye transfers superimposed on a dye receiver medium to create a color image print smaller than the size of the receiver medium and leave a non-image non-color margin area along at least one side of the color image print; and using other ones of the heating elements to effect yellow, magenta and cyan dye transfers superimposed on a non-image non-color margin area left along at least one side of the color image print to make the margin area a shade of substantially gray or black, whereby, since those heating elements which are not to be selectively used to effect the dye transfers to create the color image print are instead used to effect the dye transfers to make a non-image non-color margin area left along at least one side of the color image print a shade of substantially gray or black, uneven use of the heating elements on the print head is reduced.

According to another aspect of the invention an apparatus is provided for accomplishing each of the method steps.

DETAILED DESCRIPTION OF THE INVENTION

The invention is disclosed as being embodied preferably in a thermal printer in which the selective use, i.e. selective heating, of individual heating or resistive elements on a thermal print head effects a color dye transfer from a dye donor medium to a dye receiver medium to create a color image on the dye receiver medium. One example of such a printer is described in the "BACKGROUND OF THE INVENTION" and in prior art U.S. Pat. No. 4,745,413 issued May 17, 1988. The prior art patent is incorporated in the description of the invention which follows.

Because the features of a thermal printer are generally known, the description which follows is directed in particular only to those elements forming part of or cooperating directly with the invention. It is to be understood, however, that other elements not disclosed may take various forms known to a person of ordinary skill in the art.

Figure 1:
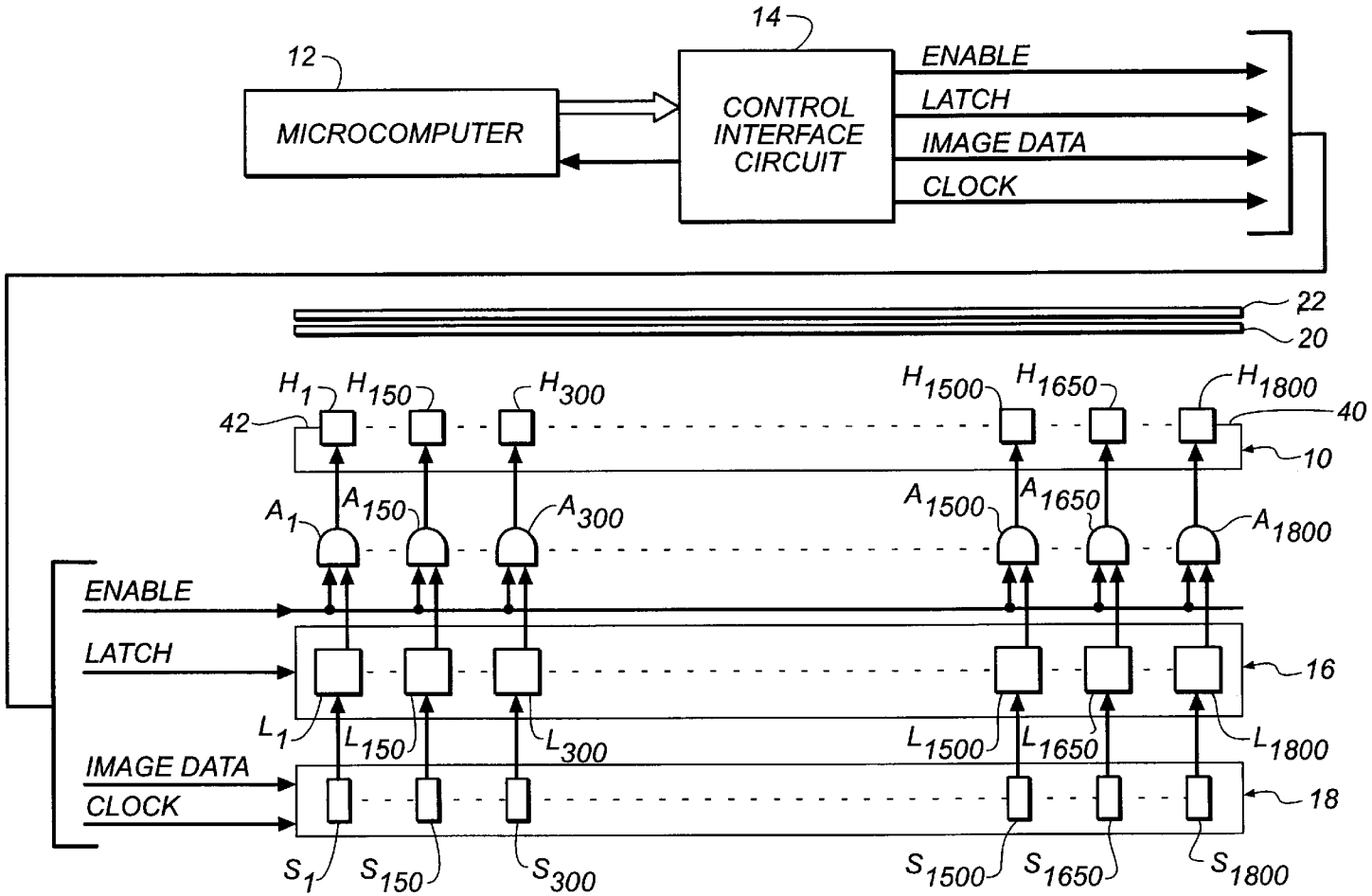
FIG. 1 is a schematic block diagram of a printer control assembly for a bead of heating elements on a print head in a thermal printer.

Referring now to the drawings, FIG. 1 is a schematic block diagram of a printer control assembly for a bead of 1800 heating or resistor elements $H_1$, $H_2$, $H_3$, $H_4$, $H_5$, $H_6$, . . . , $H_{1800}$ arranged in a straight line on a thermal print head 10 in a thermal printer.

The printer control assembly is similar in many respects to one shown in incorporated U.S. Pat. No. 4,745,413 and includes:

a suitably programmed microcomputer 12;

a control interface circuit 14 a series of 1800 AND gates $A_1$–$A_{1800}$;

a latch register 16 having a series of 1800 latch stages $L_1$–$L_{1800}$; and a shift register 18 having 1800 serial shift stages $S_1$–$S_{1800}$.

As described in incorporated U.S. Pat. No. 4,745,413, the control interface circuit 14 under the programmed direction of the microcomputer 12 provides an ENABLE signal to the AND gates $A_1$–$A_{1800}$, a LATCH signal to the latch register 16, and IMAGE DATA and CLOCK signals to the shift register 18. The IMAGE DATA signal is loaded, based on the CLOCK signal, as a serial data stream of binary $1^{'s}$ (highs) and $0^{'s}$ (lows) into the shift register 18 until all of the serial shift register stages $S_1$–$S_{1800}$ have the image data, i.e. a "1" or a "0" at each one of the shift register stages. When the image data has been completely loaded into the shift register 18, the LATCH signal causes the image data in each shift register stage $S_1$–$S_{1800}$ to be latched at the latch stages $L_1$–$L_{1800}$ in order to temporarily save the image data. The latched data then serves to determine whether each one of the heating elements $H_1$–$H_{1800}$ in the print head 10 is to be used or not used, i.e. is energized (ON) or not energized (OFF) to be heated or not heated. The ENABLE signal causes the latched data to be gated at the AND gates $A_1$–$A_{1800}$ to energize or not energize each one of the heating elements $H_1$–$H_{1800}$. In other words, a "1" loaded into the shift register stage $S_1$ and latched at the latch stage $L_1$ causes the heating element $H_1$ to be energized (ON) when the AND gate $A_1$ is enabled. Conversely, a 0" loaded into the shift register stage $S_1$ and then latched at the latch stage $L_1$ permits the heating element $H_1$ to remain not energized (OFF) when the AND gate $A_1$ is enabled. This is commonplace in known thermal heaters. See incorporated U.S. Pat. No. 4,745,413.

To make a color image print, the respective color dyes in a single series of yellow, magenta and cyan color sections on a dye donor web 20 are successively heat-transferred (e.g. by diffusion), one on top of the other, onto a dye receiver sheet 22 which, as is typical, is white. The dye transfer from each color section to the white receiver sheet 22 is done one line of pixels at a time across the color section via the bead of 1800 heating elements $H_1$–$H_{1800}$ on the thermal print head 10. See FIG. 1. The heating elements $H_1$–$H_{1800}$ make line contact across the entire width of the dye donor web 20, but only those heating elements that are actually used for a particular line are energized to be heated to effect a color dye transfer to the receiver sheet 22. When any one of the heating elements $H_1$–$H_{1800}$, is energized, the temperature to which it is heated must be high enough so that the color dye transfer to the receiver sheet 22 causes the corresponding pixel in the line to have the desired density (darkness) level. The temperature of the heating element can be raised to increase the magnitude of the color dye transfer in order to obtain the desired color density level for the corresponding pixel. As described in incorporated U.S. Pat. No. 4,745,413, this can be done by a pulse width or a pulse count modulation of the heating element. According to the pulse width modulation mode, a single constant current pulse is applied to the heating element for a variable time, controlled by the ENABLE signal, in order to vary the time the heating element is energized to effect a color dye transfer to the receiver sheet 22—depending on the desired density level for the corresponding pixel. According to the pulse count modulation mode, a variable number of constant current pulses are applied to the heating element, controlled by the number of times an IMAGE DATA signal is loaded into the shift register 18, in order to vary the number of times the heating element is energized to effect a color dye transfer to the receiver sheet 22—depending on the desired density level for the corresponding pixel. If as we assume, as in incorporated U.S. Pat. No. 4,745,413, there are N possible dye density levels, an IMAGE DATA signal is loaded into the shift register 18 the same number of times, so that the heating element can be energized N different times depending on the desired density (darkness) level for the corresponding pixel. Each time an IMAGE DATA signal is loaded into the shift register 18, the serial data stream of binary $1^{'s}$ (highs) and $0^{'s}$ (lows) is typically different to vary the density level from pixel to pixel along one line.

By way of example, the heating elements $H_1$–$H_{1800}$ can be selectively used, i.e. selectively heated, to make a 5 (width)×7 (length) inch color image print 24 on a larger 6 (width)×8 (length) inch receiver sheet 22 or to make a 6 (width)×8 length) inch color image print 26 on the 6×8 inch receiver sheet.

Figure 2:
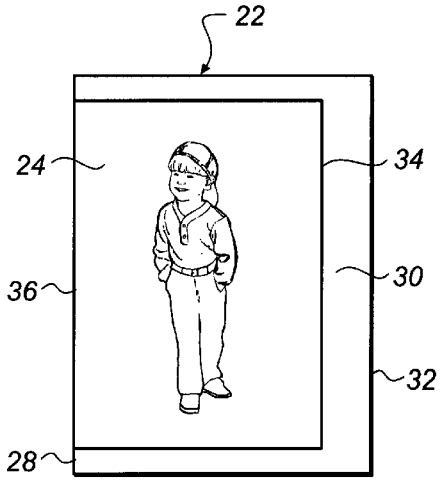
FIGS. 2–4 are illustrations of alternative placements of a 5×7 inch color image print on a 6×8 inch receiver medium as in the cross-referenced application.
Figure 3:
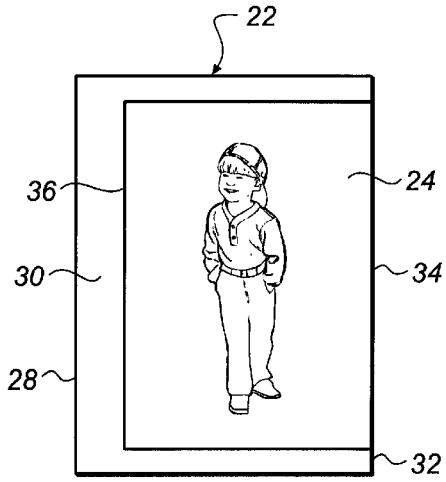
Figure 4:
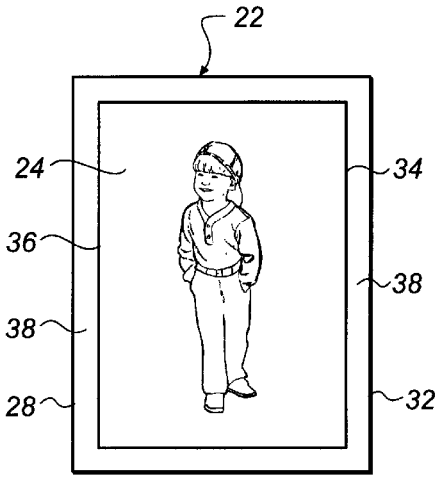

As shown in FIGS. 2–4, the placement of a 5×7 inch color image print 24 on a 6×8 inch receiver sheet 22 can be alternated or varied. In FIG. 2, a 5×7 inch color image print 24 is offset leftward on the 6×8 inch receiver sheet 24 to a first side 28 of the receiver sheet so that a 1 inch (width) non-image margin area 30 is left inwardly adjacent a second side 32 of the receiver medium, i.e. along a first side 34 of the color image print. Alternately, in FIG. 3, a 5×7 inch color image print 24 is offset rightward on the 6×8 inch receiver sheet 24 to the second side 32 of the receiver sheet so that a 1 inch (width) non-image margin area 30 is left inwardly adjacent the first side 28 of the receiver medium, i.e. along a second side 36 of the color image print. Alternately, in FIG. 4, a 5×7 inch color image print 24 is centered on the 6×8 inch receiver sheet 22 between the first and second sides 28 and 32 of the receiver sheet so that separate 0.5 inch (width) non-image margin areas 38 are left inwardly adjacent the first and second sides of the receiver medium, i.e. along the first and second sides 34 and 36 of the color image print. Each non-image margin area 30 or 38 along the first and/or second sides 34 and 36 of a 5×7 inch color image print 24 can be manually or automatically trimmed or cropped from the receiver medium (although trimming is not mandatory) using known trimming or cutting means.

Figure 5:
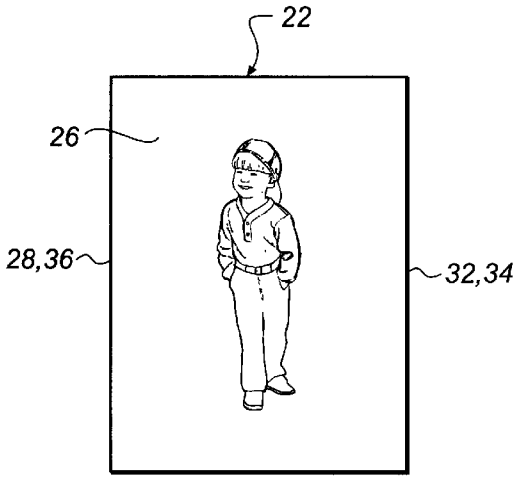
FIG. 5 is an illustration of a 6×8 inch color image print on a 6×8 inch receiver sheet as in the cross-referenced application.

On the other hand, when a 6×8 inch color image print 26 is made on the 6×8 inch receiver sheet 22, as in FIG. 5, no non-image margin area is created on the receiver sheet. Thus, the 6×8 inch color image print 26 on the 6×8 inch receiver sheet 22 is a borderless print.

To achieve the alternate placement of a 5×7 inch color image print 24 on a 6×8 inch receiver sheet 22 as in FIGS. 2–4 (as compared with making a 6×8 inch color image print 26 on the 6×8 inch receiver sheet 22 as in FIG. 5) the print-making methodology is as follows, using a known pulse count modulation mode.

To place a 5×7 inch color image print 24 on a 6×8 inch receiver sheet 22 as in FIG. 2, digital image data in the form of binary $1^{'s}$ and $0^{'s}$ is inputted from an image data source, such as a work station, into the microcomputer 12. The microcomputer 12, in turn, formulates and processes the digital image data to assemble it in a memory as respective sets or pages of yellow, magenta and cyan image data for the three color dyes in a single series of yellow, magenta and cyan color sections on the dye donor web 20. Within each data set, the image data is stored line-by-line as binary $1^{'s}$ (highs) and $0^{'s}$ (lows) to be used one line at a time to cause the corresponding color dye to be successively heat-transferred by the heating elements $H_1$–$H_{1800}$ onto the receiver sheet 22. When one line of the yellow image data is transferred to the control interface circuit 14, the interface outputs a first IMAGE DATA signal to be loaded into the shift register 18 as a serial data stream of binary $1^{'s}$ and $0^{'s}$ until all of the serial shift register stages $S_1$–$S_{1800}$ have the image data, i.e. a "1" or a "0" at each one of the shift register stages. The heating elements $H_1$–$H_{1800}$, in turn, are individually energized or not energized, to be heated or not heated depending on whether they receive a "1" or a "0". This is done again, successively, with N minus 1 IMAGE DATA signals; each IMAGE DATA signal representing a further stream of binary $1^{'s}$ and $0^{'s}$ to vary the number of times a heating element is energized, in order to print one line of yellow dye image content as pixels at varying desired density levels on the receiver sheet 22. Once all of the lines of yellow dye image content are printed on the receiver sheet 12, the sequence is repeated line-by-line to print all of the lines of magenta dye image content and then to print all of the lines of cyan dye image content on the receiver sheet 12 (in the same area, i.e. superimposed).

Figure 6:
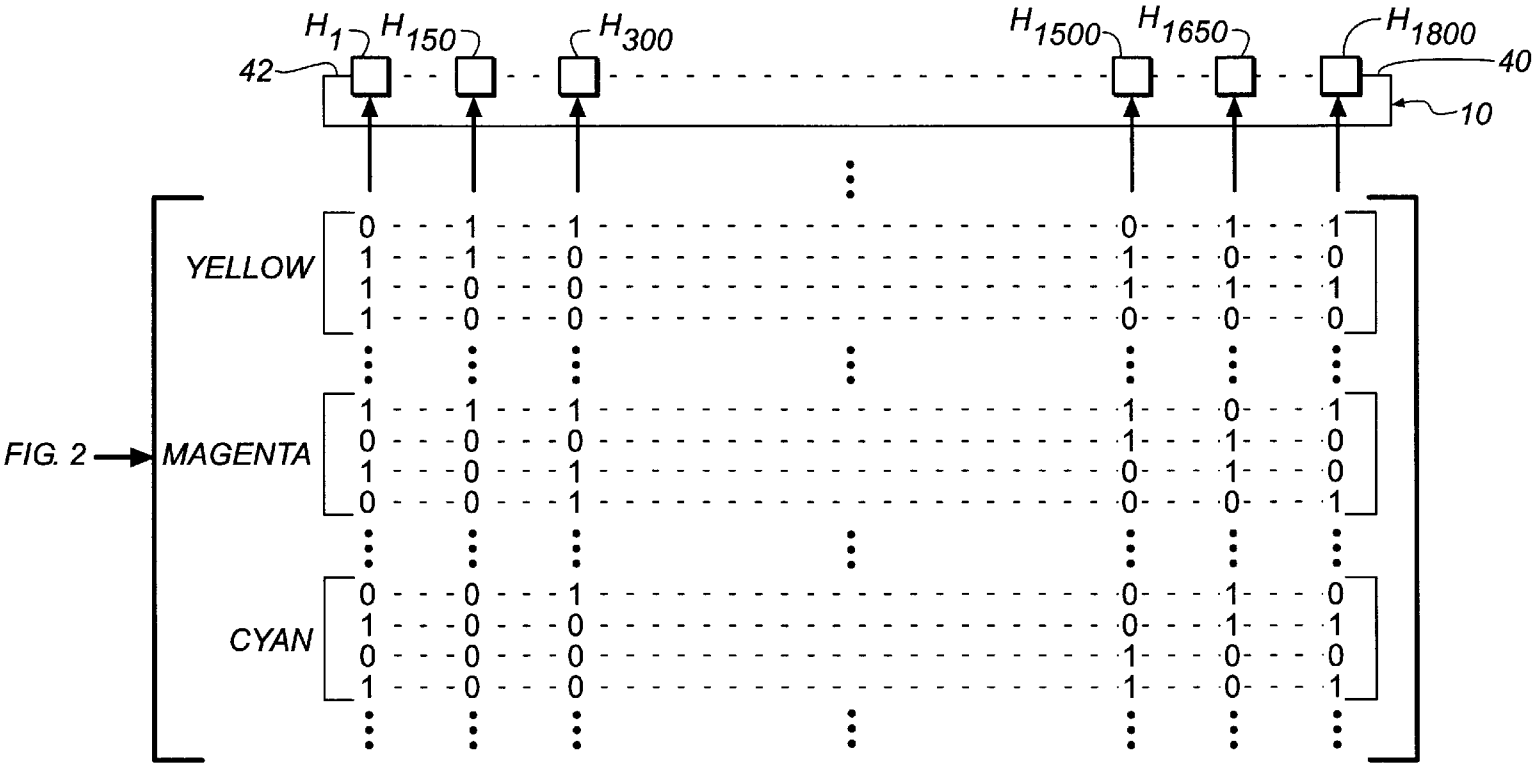
FIG. 6 is a representation of the bead of heating elements on the print head, including depicting a method of reducing uneven use of the heating elements according to a preferred embodiment of the invention.

Assuming for illustration purposes as shown in a first example (placing a 5×7 inch color image print 24 on a 6×8 inch receiver sheet 22 as in FIG. 2) in FIG. 6 that N=4, i.e. there are four possible dye density levels, then four IMAGE DATA signals are successively loaded into the shift register 18 to selectively energize the heating elements $H_1$–$H_{1800}$ a maximum number of four times for each line of yellow dye transfer, magenta dye transfer and cyan dye transfer superimposed on the receiver sheet 22. The example in FIG. 6 depicts printing only one line of the different color dyes, but in actuality all the lines of one color dye are printed before all the lines of the next color dye are printed. In FIG. 6, the heating element $H_{1500}$ is shown first receiving a "0" per the first IMAGE DATA signal, then receiving a "1" per the second IMAGE DATA signal, then receiving a "1" per the third IMAGE DATA signal, and finally receiving a "0" per the fourth or last IMAGE DATA signal, for one pixel of yellow dye transfer onto the receiver sheet 22. Also, the heating element $H_{1650}$ is shown first receiving a "1" per the first IMAGE DATA signal, then receiving a "0" per the second IMAGE DATA signal, then receiving a "1" per the third IMAGE DATA signal, and finally receiving a "0" per the fourth or last IMAGE DATA signal, for another pixel of yellow dye transfer onto the receiver sheet 22. And the heating element $H_{1800}$ is shown first receiving a "1" per the first IMAGE DATA signal, then receiving a "0" per the second IMAGE DATA signal, then receiving a "1" per the third IMAGE DATA signal, and finally receiving a "0" per the fourth or last IMAGE DATA signal, for another pixel of yellow dye transfer onto the receiver sheet 22. In other words, each one of the heating elements $H_{1500}$–$H_{1800}$, i.e. the ones closest to the a first end 40 of the line of the heating elements $H_1$–$H_{1800}$, is shown receiving the same number of $1^{'s}$, e.g. two in this instance, so that they are evenly heated (substantially to the same temperature) for the same line of yellow dye transfer onto the receiver sheet 22 (although as shown in FIG. 6, they may receive the same number of $1^{'s}$ in different orders). In contrast, the remaining heating elements $H_1$–$H_{1499}$ when receiving successive combinations of "1"'s and "0"'s per the first, second, third and fourth IMAGE DATA signals, usually receive different numbers of $1^{'s}$ so that they are heated to different temperatures for the same line of yellow dye transfer onto the receiver sheet 22. Then, once all of the lines of yellow dye transfer onto the receiver sheet 22 are done in the same manner (so that the heating elements $H_{1500}$–$H_{1800}$ continue to receive the same number of $1^{'s}$, e.g. two in this instance, for each line of yellow dye transfer), the sequence is repeated line-by-line to superimpose all of the lines of magenta dye transfer and then to superimpose all of the lines of cyan dye transfer on the lines of yellow dye transfer on the receiver sheet. Each one of the heating elements $H_{1500}$–$H_{1800}$ receive the same number of $1^{'s}$, e.g. two, for the magenta dye transfer and the cyan dye transfer as was received for the yellow dye transfer. In contrast, the remaining heating elements $H_1$–$H_{1499}$ receive different numbers of $1^{'s}$. As a result, the heating elements $H_{1500}$–$H_{1800}$ all used i.e. energized to be heated, two out of the four possible occasions for each line of yellow, magenta or cyan dye transfer onto the receiver sheet 22. The remaining heating elements $H_1$–$H_{1499}$, including the heating elements $H_1$–$H_{300}$, i.e. the ones closest to a second end 42 of the line of the heating elements $H_1$–$H_{1800}$, can be selectively used, i.e. they can be selectively energized or not energized to be heated or not heated, zero to four times out of the four occasions for one line of yellow, magenta or cyan dye transfer onto the receiver sheet 22. Thus, as in FIG. 2, the 5×7 inch color image print 24 is offset leftward on the 6×8 inch receiver sheet 22 to the first side 28 of the receiver sheet so that a 1 inch (width) non-image non-color margin area 30 is left inwardly adjacent the second side 32 of the receiver sheet, i.e. along the first side 34 of the color image print. The margin area 30 is a uniform shade of mid-gray (a mix of 50% white/50% black). If, instead, the heating elements $H_{1500}$–$H_{1800}$ always received a "0" so that they were never energized to be heated, the margin area 30 would remain white. If, alternatively, the heating elements $H_{1500}$ –$H_{1800}$ always received a "1" so that they were continuously energized to be heated, the margin area 30 would be black.

To place a 5×7 inch color image print 24 on a 6×8 inch receiver sheet 22 as in FIG. 3, the steps are the same as in the first example involving FIG. 2, except that each time an IMAGE DATA signal is loaded into the shift register 18 as a serial data stream of binary $1^{'s}$ and $0^{'s}$, the heating elements $H_1$–$H_{300}$ (instead of $H_{1500}$–$H_{1800}$), i.e. the ones closest to the second end 42 of the line of heating elements $H_1$–$H_{1800}$, receive the same number of $1^{'s}$, e.g. three in this instance, for the yellow, magenta and cyan dye transfers superimposed on the receiver sheet 12. The remaining heating elements $H_{301}$–$H_{1800}$ when receiving successive combinations of "1"'s and "0"'s for the yellow, magenta and cyan dye transfers receive different numbers of $1^{'s}$ (as in the first example shown in FIG. 6). As a result, the heating elements $H_1$–$H_{300}$ are all used. i.e. energized to be heated, three out of the four possible occasions for each line of yellow, magenta or cyan dye transfer onto the receiver sheet 22. The remaining heating elements $H_{301}$–$H_{1800}$, including the heating elements $H_{1500}$–$H_{1800}$, i.e. the ones closest to the first end 40 of the line of the heating elements $H_1$–$H_{1800}$, can be selectively used, i.e. they can be selectively energized or not energized to be heated or not heated, zero to four times out of the four occasions for one line of yellow, magenta or cyan dye transfer onto the receiver sheet 22. Thus, as in FIG. 3, the 5×7 inch color image print 24 is offset rightward on the 6×8 inch receiver sheet 22 to the second side 32 of the receiver sheet so that a 1 inch (width) non-image non-color margin area 30 is left inwardly adjacent the first side 28 of the receiver sheet, i.e. along the first side 34 of the color image print. The margin area 30 is a uniform shade of dark-gray (a mix of 25% white/75% black).

To place a 5×7 inch color image print 24 on a 6×8 inch receiver sheet 22 as in FIG. 4, the steps are the same as in the first example involving FIG. 2, except that each time an IMAGE DATA signal is loaded into the shift register 18 as a serial data stream of binary $1^{'s}$ and $0^{'s}$, the heating elements $H_1$–$H_{150}$ and $H_{1650}$–$H_{1800}$ receive the same number of $1^{'s}$, e.g. one in this instance, for the yellow, magenta and cyan dye transfers superimposed on the receiver sheet 12. The remaining heating elements $H_{301}$–$H_{1649}$ when receiving successive combinations of "1"'s and "0"'s for the yellow, magenta and cyan dye transfers receive different numbers of $1^{'s}$ (as in the first example shown in FIG. 6). As a result, the heating elements $H_1$–$H_{150}$ and $H_{1650}$–$H_{1800}$ are all used. i.e. energized to be heated, once out of the four possible occasions for each line of yellow, magenta or cyan dye transfer onto the receiver sheet 22. The remaining heating elements $H_{301}$–$H_{1649}$ can be selectively used, i.e. they can be selectively energized or not energized to be heated or not heated, zero to four times out of the four occasions for one line of yellow, magenta or cyan dye transfer onto the receiver sheet 22. Thus, as in FIG. 4, the 5×7 inch color image print 24 is centered on the 6×8 inch receiver sheet 22 between the first and second sides 28 and 32 of the receiver sheet so that separate 0.5 inch (width) non-image non-color margin areas 38 are left inwardly adjacent the first and second sides of the receiver sheet, i.e. along the first and second sides 34 and 36 of the color image print. The separate margin areas 38 are a uniform shade of light-gray (a mix of 75% white/25% black).

The microcomputer 12 is programmed, using known programming techniques, to automatically alternate the placement of each 5×7 inch color image print 24 on a receiver sheet 22 as in FIGS. 2–4. In other words, the microcomputer 12 is programmed to alternate which of the shift register stages $S_{1500}$–$S_{1800}$, $S_1$–$S_{300}$, or $S_1$–$S_{150}$ and $S_{1650}$–$S_{1800}$ receive the same number of $1^{'s}$ so that the heating elements $H_{1500}$–$H_{1800}$, $H_1$–$H_{300}$, or $H_1$–$H_{150}$ and $H_{1650}$–$H_{1800}$ are evenly heated.

When a 6×8 inch color image print 26 is made on the 6×8 inch receiver sheet 22, as in FIG. 5, the steps are the same as in the first example involving FIG. 2, except that each time an IMAGE DATA signal is loaded into the shift register 18 as a serial data stream of binary $1^{'s}$ and $0^{'s}$, the heating elements $H_1$–$H_{1800}$ when receiving successive combinations of "1"'s and 0's for the yellow, magenta and cyan dye transfers receive different numbers of 1's for all of the heating elements. As a result, the heating elements $H_1$–$H_{1800}$ can be selectively used, i.e. they can be selectively energized or not energized to be heated or not heated, zero to four times out of the four occasions for one line of yellow, magenta or cyan dye transfer onto the receiver sheet 22. Thus, as in FIG. 5, no non-image margin area is created on the receiver sheet 22. Instead, the color image print 26 is borderless.

The invention has been described in detail with particular reference to a preferred embodiment thereof, but it will be understood that variations and modifications can be effected within the spirit and scope of the invention.

For example any number of different size color image prints, besides 5×7 inch and 6×8 inch color image prints 24 as in FIGS. 2–5, which are smaller than the receiver medium 22 can be made according to the invention.

Also, all of the heating elements $H_1$–$H_{1800}$, can be initially energized to be heated, but in this instance they are all heated below the respective dye transfer thresholds for the yellow, magenta and cyan dye transfers onto the receiver sheet 22. Then, selected ones of the heating elements are further energized to be heated sufficiently to cause the color dyes to be successively heat-transferred onto the receiver sheet 22.

Also, when there is a transparent laminating section (after the cyan color section) included in each single series of yellow, magenta and cyan color sections on the dye donor web 20, the transparent laminating section can be deposited on the 5×7 inch color image print 24 or the 6×8 inch color image print 26. Preferably, the transparent laminating section is always deposited on the 6×8 receiver sheet 22 from its first side 28 to its second side 32. Alternatively, when making the 5×7 inch color image print 24, the transparent laminating section can be deposited only on the color image print (rather than on the 6×8 receiver sheet 22 from its first side 28 to its second side 32).

PARTS LIST

10. print head
$H_1$, $H_2$, $H_3$, $H_4$, $H_5$, $H_6$, . . . , $H_{1800}$. heating elements
12. microcomputer
14. control interface circuit
$A_1$–$A_{1800}$. AND gates
16. latch register
$L_1$–$L_{1800}$. latch stages
18. shift register
$S_1$–$S_{1800}$. serial shift stages
20. dye donor web
22. dye receiver sheet
24. color image print
26. color image print
28. first side of receiver sheet
30. non-image margin area
32. second side of receiver sheet
34. first side of color image print
36. second side of color image print
38. non-image margin area
40. first end of the line of the heating elements
42. second end of the line of the heating elements

What is claimed is:

1. A method of reducing uneven use of a series of heating elements on a print head in a thermal printer, when certain ones of the heating elements can be selectively used to effect yellow, magenta and cyan dye transfers superimposed on a dye receiver medium to create a color image print smaller than the size of the receiver medium so that a non-image non-color margin area is left along at least one side of the color image print, and when other ones of the heating elements are not used they leave the non-image non-color margin area unchanged, said method comprising:

selectively using certain ones of the heating elements to effect yellow, magenta and cyan dye transfers superimposed on a dye receiver medium to create a color image print smaller than the size of the receiver medium and leave a non-image non-color margin area along at least one side of the color image print; and using other ones of the heating elements to effect yellow, magenta and cyan dye transfers superimposed on a non-image non-color margin area left along at least one side of the color image print to make the margin area a shade of substantially gray or black, whereby, since those heating elements which are not to be selectively used to effect the dye transfers to create the color image print are instead used to effect the dye transfers to make a non-image non-color margin area left along at least one side of the color image print a shade of substantially gray or black, uneven use of the heating elements on the print head is reduced.

2. A method as recited in claim 1, wherein those heating elements which can be selectively used to create a color image print smaller than the size of the receiver medium are variable as to their location on the print head, but are always the same number, to able to alternately place the color image either spaced from first and second opposite sides of the receiver medium so that a non-image non-color margin area is left inwardly adjacent each opposite side of the receiver medium, or offset to the first opposite side of the receiver medium so that a non-image non-color margin area is left inwardly adjacent only the second opposite side of the receiver medium, or offset to the second opposite side of the receiver medium so that a non-image non-color margin area is left inwardly adjacent only the first opposite side of the receiver medium, and those heating elements which are used to make a non-image non-color margin area a shade of substantially gray or black are variable as to their location on the print head, but are always the same number, to be able to make the non-image non-color margin area a shade of substantially gray or black regardless of it being inwardly adjacent the first and/or second opposite sides of the receiver medium.

3. A method as recited in claim 2, wherein the series of heating elements are arranged in a line on the print head and include heating elements closest to opposite ends of the line, those heating elements which can be selectively used to create a color image print smaller than the size of the receiver medium are varied as to their location along the line to be either spaced from opposite ends of the line or closest to only one end of the line, and those heating elements which are used to make a non-image non-color margin area a shade of substantially gray or black are varied as to their location along the line to be either equally divided to be closet to both ends of the line or to be not divided so that they are spaced from one end of the line.

4. A method as recited in claim 1, wherein those heating elements which can be selectively used to create a color image print smaller than the size of the receiver medium are a predetermined number of heating elements less than the total number of heating elements, and those heating elements which are used to make a non-image non-color margin area left along at least one side of the color image print a shade of substantially gray or black are a smaller number of heating elements less than the predetermined number that together with the predetermined number constitute the total number.

5. A method as recited in claim 4, wherein the total number of heating elements are selectively used to effect yellow, magenta and cyan dye transfers superimposed on a dye receiver medium to create a color image print substantially the same size as the receiver medium so that there is no non-image non-color margin area left along either side of the color image print.

6. A method as recited in claim 4, wherein the total number of heating elements are arranged in a line on the print head and include heating elements closest to opposite ends of the line, and the smaller number of heating elements which are used to make a non-image non-color margin area left along at least one side of the color image print a shade of substantially gray or black are closet to at least one end of the line.

7. A method as recited in claim 1, wherein a non-image non-color margin area left along at least one side of the color image print is cut off the receiver medium after being made a shade of substantially gray or black.

8. A method as recited in claim 1, wherein the receiver medium is originally white so that a non-image non-color margin area left along at least one side of the color image print is changed from initially being white to a shade of substantially gray or black.

9. A method of reducing uneven use of a total number of heating elements on a print head in a thermal printer, when the total number can be selectively used in order to effect yellow, magenta and cyan dye transfers superimposed on a dye receiver medium to create a color image print substantially the same size as the receiver medium so that no non-image non-color margin area is left along either side of the color image print, when a predetermined number less than the total number can be selectively used to effect yellow, magenta and cyan dye transfers superimposed on a dye receiver medium to create a color image print smaller than the size of the receiver medium so that a non-image non-color margin area is left along at least one side of the color image print, and when a smaller number less than the predetermined number are not used they leave the non-image non-color margin area unchanged, said method comprising:

selectively using the total number of heating elements to effect yellow, magenta and cyan dye transfers superimposed on a dye receiver medium to create a color image print substantially the same size as the receiver medium so that there is no non-image non-color margin area left along either side of the color image print;

selectively using the predetermined number of heating elements to effect yellow, magenta and cyan dye transfers superimposed on a dye receiver medium to create a color image print smaller than the size of the receiver medium and leave a non-image area along at least one side of the color image print; and using the smaller number of heating elements to effect yellow, magenta and cyan dye transfers superimposed on a non-image margin area left along at least one side of a color image print smaller than the size of the receiver medium to make the margin area a uniform shade of gray or black, whereby, since the smaller number of heating elements are to be used when the predetermined number of heating elements are to be selectively used, uneven use of the total number of heating elements is reduced.

10. A method as recited in claim 9, wherein the total number of heating elements which can be selectively used to create a color image print substantially the same size as the receiver medium are arranged in a line on the print head and include heating elements closest to opposite ends of the line, the predetermined number of heating elements which can be selectively used to create a color image print smaller than the size of the receiver medium are chosen to be either spaced from opposite ends of the line or closest to only one end of the line, and the smaller number of heating elements which are used to make a non-image non-color margin area a shade of substantially gray or black are chosen to be either equally divided to be closet to both ends of the line or to be not divided so that they are spaced from one end of the line.

11. Apparatus for reducing uneven use of a series of heating elements on a print head in a thermal printer, comprising:

means for selectively using certain ones of said heating elements to effect yellow, magenta and cyan dye transfers superimposed on a dye receiver medium to create a color image print smaller than the size of the receiver medium and leave a non-image non-color margin area along at least one side of the color image print; and means for using other ones of said heating elements to effect yellow, magenta and cyan dye transfers superimposed on a non-image non-color margin area left along at least one side of the color image print to make the margin area a shade of substantially gray or black, whereby, since those heating elements which are not to be selectively used to effect the dye transfers to create the color image print are instead used to effect the dye transfers to make a non-image non-color margin area left along at least one side of the color image print a shade of substantially gray or black, uneven use said heating elements on the print head is reduced.

12. A method of reducing uneven use of a series of heating elements on a print head in a thermal printer, when the heating elements can be used to effect yellow, magenta and cyan dye transfers superimposed on a dye receiver medium to create a color image print smaller than the size of the receiver medium so that a non-image non-color margin area is left along at least one side of the color image print, said method comprising:

assigning one subgroup consisting of the majority of heating elements to be selectively used to effect yellow, magenta and cyan dye transfers superimposed on a dye receiver medium to create a color image print smaller than the size of the receiver medium so that a non-image non-color margin area along at least one side of the color image print; and assigning another subgroup consisting of a minority of heating elements, not included in the subgroup of the heating elements to be selectively used to effect the dye transfers to create a color image smaller than the receiver medium, to be used to effect yellow, magenta and cyan dye transfers superimposed on a non-image non-color margin area left along at least one side of the color image print to make the margin area a shade of substantially gray or black, whereby, since those heating elements in the subgroup not to be selectively used to effect the dye transfers to create the color image print are instead used to effect the dye transfers to make a non-image non-color margin area left along at least one side of the color image print a shade of substantially gray or black, uneven use of the series of heating elements on the print head is reduced.

* * * * *

UNITED STATES PATENT AND TRADEMARK OFFICE

CERTIFICATE OF CORRECTION

PATENT NO. : 6,744,454 B2
DATED : June 1, 2004
INVENTOR(S) : Robert F. Mindler et al.

It is certified that error appears in the above-identified patent and that said Letters Patent is hereby corrected as shown below:

Title page,
Item [57], ABSTRACT, should read:

--A method for thermal printing wherein a color image print smaller than the size of the receiver medium and leave a non-image non-color margin area along at least one side of the color image print; and using other ones of the heating elements to effect yellow, magenta and cyan dye transfer superimposed on a non-image non-color margin area left along at least one side of the color image print to make the margin area a shade of substantially gray or black, whereby, since those heating elements which are not to be selectively used to effect the dye transfers to create the color image print are instead used to effect the dye transfers to make a non-image non-color margin area left along at least one side of the color image print a shade of substantially gray or black, uneven use of the heating elements on the print head is reduced. --

Signed and Sealed this

Twenty-second Day of March, 2005

JON W. DUDAS
*Director of the United States Patent and Trademark Office*